US011538642B2

(12) United States Patent
Hussmann

(10) Patent No.: US 11,538,642 B2
(45) Date of Patent: Dec. 27, 2022

(54) SWITCHING DEVICE AND METHOD

(71) Applicant: Siemens Aktiengesellschaft, Munich (DE)

(72) Inventor: Joerg Hussmann, Neumarkt (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 17/261,964

(22) PCT Filed: Jul. 12, 2019

(86) PCT No.: PCT/EP2019/068876
§ 371 (c)(1),
(2) Date: Jan. 21, 2021

(87) PCT Pub. No.: WO2020/030379
PCT Pub. Date: Feb. 13, 2020

(65) Prior Publication Data

US 2021/0296059 A1 Sep. 23, 2021

(30) Foreign Application Priority Data

Aug. 8, 2018 (DE) ..... 10 2018 213 354.9

(51) Int. Cl.
*H01H 9/02* (2006.01)
*H01H 9/16* (2006.01)
*H01H 9/54* (2006.01)

(52) U.S. Cl.
CPC ..... *H01H 9/02* (2013.01); *H01H 9/16* (2013.01); *H01H 9/547* (2013.01); *H01H 2009/0292* (2013.01)

(58) Field of Classification Search
CPC ..... H01H 9/02; H01H 9/16; H01H 9/547; H01H 9/542; H01H 9/548; H01H 9/56;
(Continued)

(56) References Cited

U.S. PATENT DOCUMENTS 4,636,907 A 1/1987 Howell
5,638,038 A * 6/1997 Suzuki ..... H01H 71/405 335/35

(Continued)

FOREIGN PATENT DOCUMENTS

DE 3622098 A1 1/1987
DE 19944043 A1 3/2001

(Continued)

OTHER PUBLICATIONS

Translation of DE19944043 (Original document published Mar. 15, 2001) (Year: 2001).*

(Continued)

*Primary Examiner* — William A Bolton
(74) *Attorney, Agent, or Firm* — Harness, Dickey & Pierce, P.L.C.

(57) ABSTRACT

A switching device is for a low-voltage electric circuit having a plurality of conductors. In an embodiment, the switching device includes a housing having connection contacts arranged on the housing for connection of conductors of the low-voltage electric circuit; and a mechanical unit situated in the housing having an isolating function and an OFF or IN position, the mechanical unit including isolating contacts for galvanically interrupting the conductors of the low-voltage electric circuit. An electronic unit is provided which is connected to the mechanical unit in series on the current flow side; an auxiliary switch connected to the mechanical unit is provided and is connected in turn to the electronic unit; and the auxiliary switch and the electronic unit are designed in such a way that the electronic unit is highly resistive during an opening process of the mechanical unit.

23 Claims, 1 Drawing Sheet

(58) Field of Classification Search
CPC ... H01H 2009/0292; H01H 3/332; H01H 3/26
USPC ..... 200/293
See application file for complete search history.

(56) References Cited

U.S. PATENT DOCUMENTS

| | | | | |
|---|---|---|---|---|
| 5,793,586 | A * | 8/1998 | Rockot | H01H 9/541 361/8 |
| 8,159,318 | B2 * | 4/2012 | Yang | H01H 71/123 335/38 |
| 8,810,991 | B2 * | 8/2014 | Scharnick | H01H 47/005 361/115 |
| 9,312,081 | B2 * | 4/2016 | Douglass | H01H 9/547 |
| 2007/0109704 | A1 | 5/2007 | Apfelbacher et al. | |
| 2013/0206728 | A1 | 8/2013 | Amoako et al. | |
| 2014/0117776 | A1 * | 5/2014 | Gambach | H01H 33/596 307/113 |
| 2016/0322184 | A1 | 11/2016 | Schmitz et al. | |

FOREIGN PATENT DOCUMENTS

| | | | |
|---|---|---|---|
| DE | 10334069 | A1 | 3/2005 |
| DE | 102013114259 | A1 | 6/2015 |
| EP | 2908398 | A2 | 8/2015 |
| EP | 3091550 | A1 | 11/2016 |
| WO | WO 9311608 | A1 | 6/1993 |
| WO | WO 2015075189 | A1 | 5/2015 |

OTHER PUBLICATIONS

PCT International Search Report and Written opinion of International Searching Authority dated Oct. 24, 2019 corresponding to PCT International Application No. PCT/EP2019/068876 filed on Jul. 12, 2019.

German Search Report for German application No. 10 2018 213 354.9 dated Apr. 30, 2019.

* cited by examiner

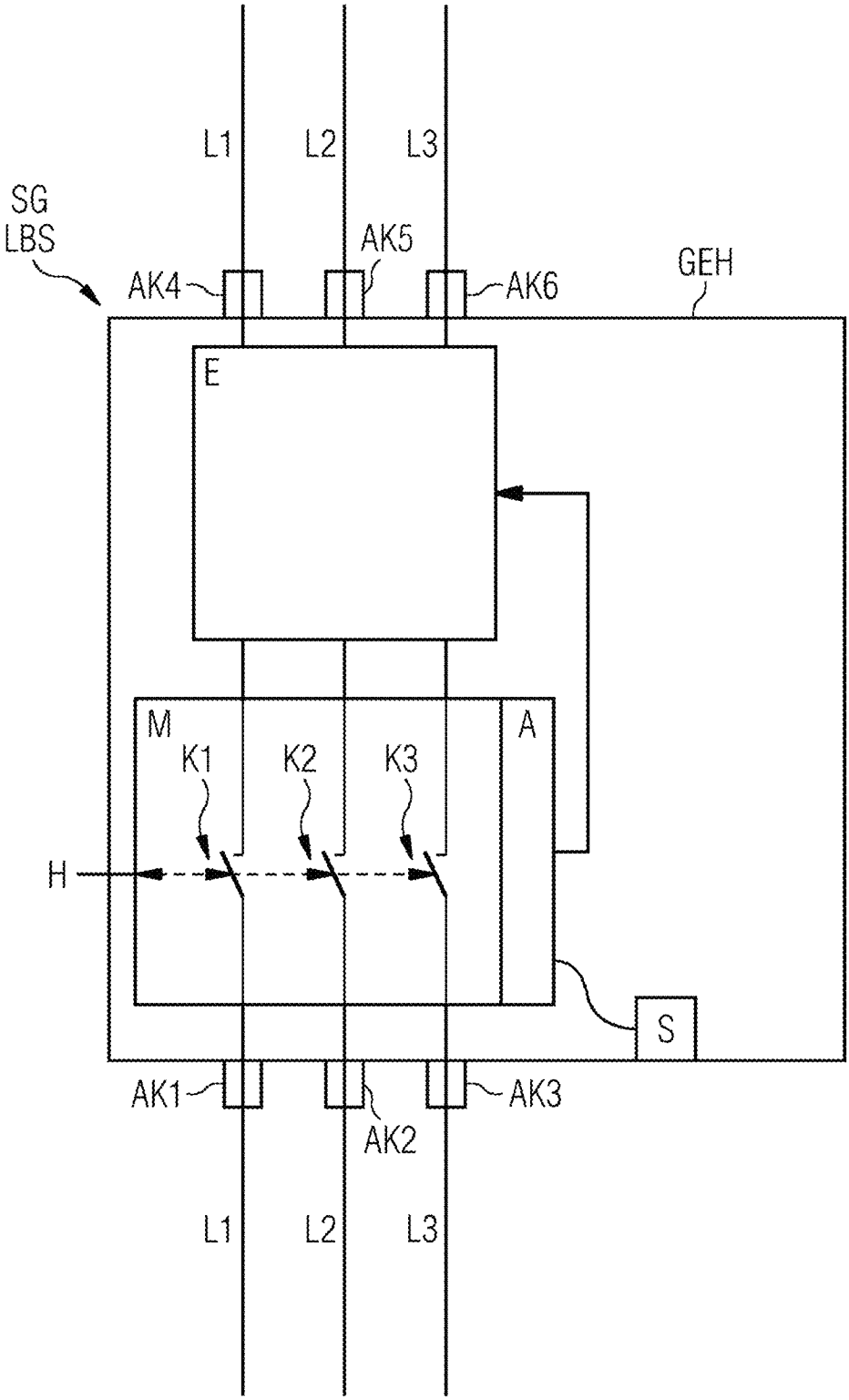
L1
L2
L3
SG
LBS
AK5
AK4
AK6
GEH
E
M
A
K1
K2
K3
H
S
AK1
AK3
AK2
L1
L2
L3

SWITCHING DEVICE AND METHOD

PRIORITY STATEMENT

This application is the national phase under 35 U.S.C. § 371 of PCT International Application No. PCT/EP2019/068876, which has an International filing date of Jul. 12, 2019, which designated the United States of America and which claims priority to German patent application 102018213354.9 filed Aug. 8, 2018, the entire contents of each of which are hereby incorporated herein by reference.

FIELD

The present application generally relates to a switching device for interrupting a low-voltage circuit having a plurality of conductors; and to a method for a switching device having an isolating function.

BACKGROUND

Isolating switches or load-break switches are generally known.

Isolators or isolating switches are electrical activation systems which are designed to perform load-free (currentless) electrical isolation of electrical low-voltage circuits or systems (components). Electrical isolation under load is not possible, or possible only to a limited degree, using conventional isolators and owing to an electric arc which occurs during the isolation process can bring about the destruction of the isolator.

Load isolators or load-break switches are electrical activation systems which are designed to bring about electrical isolation of electrical low-voltage circuits or systems (components) under load. For this, load isolators have, for example, an electric arc quenching device by which an electric arc which occurs in the case of electrical isolation under load can be conducted away from switching elements of the load isolator and can be quenched in a heat-resistant section of the electric arc-quenching device such as e.g. an electric arc quenching chamber. In this way, thermal overloading of sensitive components of the load isolator which is caused by the electric arc can be avoided.

One particular embodiment of isolators or load isolators are load isolators with fuses, such as fused load isolators or fused load-break switches. Fused load isolators are load isolators which have an electrical fuse, such as a safety fuse, for example what is referred to as an NH fuse.

Usually, isolating switches or load-break switches are activated manually, for example by way of a handle, e.g. in the form of a knob or lever, which open contacts of the switch so that galvanic isolation is implemented, in particular with an isolating gap or protection gap.

An interruption in the case of short circuits, in particular a repeated interruption, is not provided with isolating switches or load-break switches. Nevertheless, switching onto a short circuit is permitted in the case of isolating switches and load-break switches.

In fused isolating switches or fused load-break switches there is basically also only manual interruption provided and the fuse serves only as an additional protection for extreme situations. Usually in the case of fused isolating switches, the fuse does not have to be changed until the low-voltage circuit or the system can be supplied with energy again.

In contrast to this, power switches, power protection switches and circuit breakers are known. The interruption of the circuit is carried out here automatically or manually, generally automatically when certain overcurrent conditions, short-circuit conditions or fault current conditions are present. After an interruption, these devices can be switched on again relatively quickly. Manual switching off is also possible.

The terms line protection switches and power switches refer to protection devices or protection switching devices which function similarly to a fuse. Line protection switches and power switches monitor the current flowing through them by way of at least one conductor and interrupt the electrical current or flow of energy to an energy sink or a consumer, which is referred to as triggering, if protection parameters, such as current limiting values or current/time/voltage limiting values, i.e. if a current value is present for a certain period of time, are exceeded. The interruption occurs here in a mechanical way through opening of contacts.

Circuit breakers determine the sum of the currents in an electrical circuit, which is zero in a normal case, and interrupt electrical current when a differential current value, i.e. a sum of the current which is unequal to zero and which exceeds a specific (differential) current value or fault current value, is exceeded. The interruption takes place automatically here.

The term low voltage is meant to refer to voltages up to 1000 volts AC voltage and/or 1500 volts DC voltage. The term low voltage is understood to refer in particular to voltages which are higher than an extra-low voltage with values of 50 volt AC voltage and 120 volt DC voltage.

The term circuits, in particular for low voltage, is understood to refer to circuits for currents up to 6300 amperes, specifically currents up to 1600 amperes, 1200 amperes, 630 amperes, 125 amperes, 80 amperes, 63 amperes, 40 amperes, 25 amperes or 16 amperes. The specified current values are understood to refer, in particular, to rated value and/or cut-off currents, i.e. the current which is in a normal case the maximum one conducted across the circuit, or at which current the electrical circuit is usually interrupted, for example by a switching device or a protection device or a protection switching device such as a power switch or line protection switch.

SUMMARY

At least one embodiment of the invention relates to switching devices with an isolating function. The term isolating function is meant to refer to a certain minimum distance or minimum clearance between the contacts of the switching device. This minimum clearance is essentially voltage-dependent. Further parameters are the degree of soiling, the type of field (homogeneous, nonhomogeneous) and the air pressure or the height above mean sea level.

According to at least one embodiment of the invention, a switching device for a low-voltage circuit having a plurality of conductors is provided, comprising a housing with connection contacts which are arranged on the housing and have the purpose of connecting conductors of the low-voltage circuit, and a mechanical unit which is located in the housing, has an isolating function, an OFF or ON position (opened or closed) and isolating contacts for galvanically interrupting the conductors of the low-voltage circuit (i.e. the isolating contacts or switching contacts are opened or closed).

In addition, according to at least one embodiment of the invention, a corresponding method for a switching device is disclosed.

BRIEF DESCRIPTION OF THE DRAWINGS

The described properties, features and advantages of embodiments of the invention as well as the way in which they are achieved become clearer and more readily understandable in conjunction with the following description of the example embodiment and are explained in more detail in conjunction with the drawing.

In this context, the drawing shows a FIGURE.

The FIGURE shows a basic illustration of a novel switching device.

DETAILED DESCRIPTION OF THE EXAMPLE EMBODIMENTS

These minimum clearances or creepage distances are subject to corresponding regulations or standards. These regulations specify, for example for a surge voltage resistance in the case of air, the minimum clearance for a nonhomogeneous and for a homogeneous (ideal) electrical field as a function of the degree of soiling. The surge voltage resistance is the resistance when a corresponding surge voltage is applied. The switching device or the switching equipment has an isolating function (isolator property) only when this minimum distance (minimum clearance) is present.

According to at least one embodiment of the invention, in this context the series of Standards DIN EN 60947 and IEC 60947 are relevant for the isolating function and its properties, and reference is made hereto.

In particular in the case of switching, i.e. in particular in the case of opening, there is a problem that at high currents large electric arcs occur and the switches have to be correspondingly robust and have correspondingly large dimensions. The number of interruptions at high currents is limited.

At least one embodiment of the present invention improves a switching device with an isolating function of the type mentioned at the beginning, in particular improves the switching and the number of possible switching processes and to increase the service life.

According to at least one embodiment of the invention, a switching device for a low-voltage circuit having a plurality of conductors is provided, comprising a housing with connection contacts which are arranged on the housing and have the purpose of connecting conductors of the low-voltage circuit, and a mechanical unit which is located in the housing, has an isolating function, an OFF or ON position (opened or closed) and isolating contacts for galvanically interrupting the conductors of the low-voltage circuit (i.e. the isolating contacts or switching contacts are opened or closed).

According to at least one embodiment, the invention an electronic unit is provided which is connected to the mechanical unit in series on the current flow side, in that an auxiliary switch is provided which is connected to the mechanical unit and is in turn connected to the electronic unit, in that the auxiliary switch and the electronic unit are configured in such a way that during an opening process of the mechanical unit the electronic unit has high impedance.

The term high impedance is meant to refer to a state in which only a current with a negligible magnitude is flowing. In particular, high impedance is understood to refer to resistance values higher than 1 kiloohm, better higher than 10 kiloohms, 100 kiloohms, 1 megaohm, 10 megaohms, 100 megaohms, 1 gigaohm, 10 gigaohms, 100 gigaohms, 1 teraohm or higher.

This has the particular advantage that the level of the electrical current of the low-voltage circuit is greatly reduced during a switching process, so that switching can be carried out virtually without power or free of power in ideal terms. As a result, switching electric arcs can be avoided and the mechanical contacts are subjected to less loading. As a result, the number of possible switching processes and/or the service life can be greatly increased.

Advantageous refinements of embodiments of the invention are specified in the claims.

In one advantageous refinement of at least one embodiment of the invention, the isolating function is characterized by:

visibility of the isolating contacts in the OFF position, in particular through a transparent part of the housing, or an, in particular unambiguous, display of the position of the isolating contacts, in particular, by an operator control lever, a switch position display or a display device.

This has the particular advantage that there is clear detection of the isolating function.

In one advantageous refinement of at least one embodiment of the invention, the isolating function is characterized by a minimum clearance of the opened isolating contacts in the OFF position (opened position, opened contacts) as a function of the rated surge voltage impedance and the degree of soiling. The minimum clearance is, in particular, between 0.01 mm and 14 mm.

This has the particular advantage of simple implementation of the minimum clearance.

In one advantageous refinement of at least one embodiment of the invention, the isolating function is characterized by a minimum clearance of the opened isolating contacts in the OFF position as a function of the rated surge voltage impedance and the degree of soiling. The minimum clearance is between 0.01 mm at 0.33 kV and 14 mm at 12 kV, in particular for a degree of soiling 1 and in particular for nonhomogeneous fields.

In one advantageous refinement of at least one embodiment, the minimum clearance can have the following values:

E DIN EN 60947-1 (VDE 0660-100):2018-06

TABLE 13

| Minimum clearances | | | | | | | | |
|---|---|---|---|---|---|---|---|---|
| | Minimum clearances mm | | | | | | | |
| Rated surge voltage resistance $U_{imp}$ | Case A nonhomogeneous field (see 3.7.63) Degree of soiling | | | | Case B homogeneous field, ideal conditions (see 3.7.62) Degree of soiling | | | |
| kV | 1 | 2 | 3 | 4 | 1 | 2 | 3 | 4 |
| 0.33 | 0.01 | | | | 0.01 | | | |
| 0.5 | 0.04 | 0.2 | | | 0.04 | 0.2 | | |
| 0.8 | 0.1 | | 0.8 | | 0.1 | | 0.8 | 1.6 |
| 1.5 | 0.5 | 0.5 | | 1.6 | 0.3 | 0.3 | | |
| 2.5 | 1.5 | 1.5 | 1.5 | | 0.6 | 0.6 | | |
| 2.0 | 3 | 3 | 3 | 3 | 1.2 | 1.2 | 1.2 | |
| 6.0 | 5.5 | 5.5 | 5.5 | 5.5 | 2 | 2 | 2 | 2 |
| 8.0 | 8 | 8 | 8 | 8 | 3 | 3 | 3 | 3 |
| 12 | 14 | 14 | 14 | 14 | 4.5 | 4.5 | 4.5 | 4.5 |

NB: The specified smallest air gaps are based on the 1.2/50 μs surge voltage at an air pressure of 80 kPa, which corresponds to the air pressure at 2000 m above mean sea level.

The degrees of soiling and the types of field correspond to those defined in the Standards.

This has the particular advantage that a Standard-compliant switching device which is dimensioned in accordance with the rated surge voltage resistance is obtained.

In one advantageous refinement of at least one embodiment of the invention, the mechanical unit has an operator control lever or a switching mechanism which is driven manually, by motor, pneumatically or by a spring mechanism, in order to activate the isolating contacts in order to bring about the OFF or ON position (opened or closed contacts).

This has the particular advantage that a particularly simple possible way of activating the mechanical unit is provided or simple implementation for the mechanical switching process is provided.

In one advantageous refinement of at least one embodiment of the invention, in an opening process of the mechanical unit (M), the impedance of the electronic unit (E) becomes high:

a) before the opening of the contacts (K), b) during the opening of the contacts (K) or c) after the opening of the contacts (K).

This has the particular advantage that, in particular in the case of high impedance, the switching power is minimized to a high degree before the opening of the contacts. However, even during or after the opening the switching power can be reduced or an electric arc can be quenched, in particular in the case of DC voltage.

In one advantageous refinement of at least one embodiment of the invention, the mechanical unit is a mechanical unit of a load-break switch. The switching device is, in particular, an isolating switch or load-break switch.

This has the particular advantage that the switching can be improved to a particularly high degree here, since, as it were, it is possible to switch without power, in particular in the case of high impedance just before the opening of the contacts. The activation of the operator control lever or switching lever, which can be assisted by a switching mechanism which is driven by motor, pneumatically or by a spring mechanism, brings about here (in particular exclusive) control of the electronic unit which decreases the level of the current.

In one advantageous refinement of at least one embodiment of the invention, in a closing process of the mechanical unit, i.e. to the ON position, the impedance of the electronic unit becomes low after the closing of the contacts.

This has the particular advantage that a load-break circuit is switched on, as it were, without power or without power in ideal terms.

The term low impedance is understood to mean a state in which the current value which is specified at the load-break circuit could flow.

In particular, the term low impedance is understood to mean resistance values which are less than 10 ohms, better less than 1 ohm, 100 milliohms, 10 milliohms, 1 milliohm, 100 microohms, 10 microohms, 1 microohm, 100 nanoohms, 10 nanoohms, 1 nanoohm or less.

In one advantageous refinement of at least one embodiment of the invention, the electronic unit is embodied with semiconductors, in particular is a semiconductor switch, for example with bipolar transistors, field-effect transistors, thyristors and/or isolator gate bipolar transistors (IGBT).

This has the particular advantage that a simple implementation of an electronic unit is made possible.

In one advantageous refinement of at least one embodiment of the invention, when a mechanical unit is opened, the electronic unit has high impedance.

This has the particular advantage that in the basic state the electronic unit has high impedance, as a result of which the flow of current is reduced or interrupted, so that switching, in particular switching on, can be carried out, as it were, without power.

In one advantageous refinement of at least one embodiment of the invention, the auxiliary switch is mechanically connected to the mechanical unit. Before the opening of the (mechanical) contacts, an electrical contact of the auxiliary switch opens, so that an electrical auxiliary circuit which is connected to the electronic unit (and which has the auxiliary circuit) is opened, so that the electronic unit subsequently reduces the electrical current in the conductors of the low-voltage circuit, in particular interrupts them in ideal terms. For example in that their impedance becomes high.

Alternatively, this can take place inversely by opening the auxiliary switch or generally by way of a change of contacts, in particular also by way of a wiping contact.

This has the particular advantage that a simple implementation for the actuation of the electronic unit is provided.

In one advantageous refinement of at least one embodiment of the invention, when contacts of the mechanical unit are opened, the electronic unit has high impedance. After the closing of the contacts the electrical contacts of the auxiliary switch is closed so that the electrical auxiliary circuit is closed, so that the impedance of the electronic unit then becomes low, in particular the electronic unit ideally becomes super-conductive.

This has the particular advantage that simple implementation is provided for the actuation of the electronic unit in a switching-on process.

In one advantageous refinement of at least one embodiment of the invention, a switch is provided which is connected to the electronic unit. Both are configured in such a way that switching can be performed with the switch between high-impedance and low-impedance states of the electronic unit; in particular only in the closed state of the mechanical unit.

This has the particular advantage that in addition to the mechanical interruption, an electronic interruption—independent thereof—of the low-voltage circuit is also made possible, which makes available a further functionality of a novel load-break switch. However, this does not provide an isolating function in the sense of galvanic isolation, but nevertheless provides a new practical functionality.

In one advantageous refinement of at least one embodiment of the invention, the auxiliary switch has a sensor.

This has the particular advantage that a simple implementation for an auxiliary switch is provided.

In one advantageous refinement of at least one embodiment of the invention, the auxiliary switch is embodied as a module which can be coupled to the mechanical unit.

This has the particular advantage that a modular design is provided and, if appropriate, existing switching devices can be retrofitted.

In one advantageous refinement of at least one embodiment of the invention, the switching device is configured in such a way that in the de-energized state of the low-voltage circuit the mechanical unit can always be moved into the OFF position in order to implement the isolating function.

This has the particular advantage that a particularly safe electronic switching device is provided which is always moved into the OFF state with an isolating function.

In one advantageous refinement of at least one embodiment of the invention, the switching device is configured in such a way that in the no-voltage state of the low-voltage circuit and in the OFF position of the mechanical unit the electronic unit continues to have high impedance at the changeover to the state in which voltage is applied.

This has the particular advantage that a particularly safe switching device is provided which in such a case prevents a possibly intended flow of current.

In one advantageous refinement of at least one embodiment of the invention, the electronic unit is configured in such a way that when a current limiting value of the low-voltage circuit is exceeded, the electronic unit changes into the high-impedance state.

This has the particular advantage that protection of both the electronic unit and of the low-voltage circuit is provided.

In an advantageous refinement of at least one embodiment of the invention, the electronic unit is coupled to the mechanical unit in such a way that when the current limiting value is exceeded and the electronic unit changes into the high-impedance state the mechanical unit is moved into the OFF position, in order to bring about the isolating function.

This has the particular advantage that in addition to the protection of the electronic unit and of the low-voltage circuit, an isolating function according to the Standard is provided. A very high-performance novel switching and protection device is therefore provided.

In addition, according to at least one embodiment of the invention, a corresponding method for a switching device is disclosed.

All the refinements, both referred back in a form to other embodiments and referred back only to individual features or combinations of features of embodiments, bring about an improvement in a switching device, in particular in order to increase the number of possible switching processes and/or the service life.

The FIGURE shows a switching device SG according to the invention for a low-voltage circuit having a plurality of conductors L1, L2, L3.

The switching device SG has a housing GEH with connection terminals AK1, . . . , AK6 for the conductors L1, L2, L3 of the low-voltage circuit. The connection terminals are provided on the housing.

A three-phase AC circuit with a first conductor L1, a second conductor L2 and a third conductor L3 are illustrated in the example. However, it is e.g. also possible to have a single-phase AC circuit with two conductors, e.g. external conductor and neutral conductor, or a three-phase AC circuit with a neutral conductor, that is to say with four conductors.

In one refinement, the conductors L1, L2, L3 are connected on the input side, in particular on the energy-source-side, to a mechanical unit M which is to be activated manually, in particular exclusively manually, and which has contacts K1, K2, K3 for interrupting the conductors L1, L2, L3. The contacts K1, K2, K3 can be opened and closed by way of an operator control lever H such as a handle, for example in the form of a toggle or lever, which is to be activated manually, so that a possibility of opening and closing the contacts K1, K2, K3 is provided for the conductors L1, L2, L3 of the low-voltage circuit. In particular a galvanic isolating function is implemented with the mechanical unit M, for example according to the Standard IEC 60947.

Alternatively or additionally, a manual switching mechanism which is operated by motor, by pneumatics or by a spring mechanism can be provided, in order to activate the isolating contacts (K1, K2, K3) in order to bring about the OFF or ON position or to assist the process.

In this refinement, the conductors L1, L2, L3 are on the other hand connected to an electronic unit E, in particular on the energy sink side or consumer side.

The switching device can be connected to energy sinks or on the energy source side, but also the other way round (the energy source can be connected to the electronic unit, and the energy sink to the mechanical unit).

The mechanical unit M is in turn connected to the electronic unit E, in particular the conductors L1, L2, L3 form a connection. In electrical terms, there is a series connection of the mechanical unit and the electrical unit, which is implemented by way of the conductors.

According to at least one embodiment of the invention, an auxiliary switch A is also provided which is connected to the mechanical unit M and is in turn connected to the electronic unit E, in particular is connected electrically, for example by way of an auxiliary circuit.

The auxiliary switch A and the electronic unit E are configured in such a way that in an opening process of the mechanical unit M the impedance of the electronic unit E becomes high before the opening of the contacts K, during the opening of the contacts or after the opening of the contacts, in particular shortly before the opening of the contacts, i.e. the isolating contacts are no longer in contact with one another. Switching off is therefore performed, as it were, in a currentless or no-load state.

In addition, in a closing process of the mechanical unit M, the impedance of the electronic unit (E) becomes low only after the closing of the contacts of the mechanical unit. Therefore, switching on is carried out, as it were, without current or without load.

The electronic unit can be embodied with semiconductors, in particular can be a semiconductor switch.

Generally, the electronic unit E can have high impedance, so that a safe basic state is provided, in particular in the case of an opened mechanical unit.

The electronic unit E can contain a further overcurrent protection (or short circuit protection) so that when a current limiting value is exceeded or when a current/time period limiting value is exceeded, i.e. a current value is present for a certain time period, the circuit is interrupted (the electrical current or high impedance is reduced) by the electronic unit E.

At least one embodiment of the invention can be configured in such a way that the auxiliary switch A is connected mechanically to the mechanical unit M, that before the opening of the contacts E an electrical contact of the auxiliary switch A opens, so that an electrical auxiliary circuit which is connected to the electronic unit E and has the auxiliary switch is opened, so that the electronic unit E then reduces, in particular interrupts in ideal terms, the electric current of the conductors L1, L2, L3 of the low-voltage circuit.

In addition, when the contacts K of the mechanical unit are opened, the electronic unit E can have high impedance. After the closing of the contacts K of the mechanical unit M, the electrical contact of the auxiliary switch A is closed, so that the impedance of the electronic unit E then becomes low. In particular, it can become super-conductive or approximately super-conductive in ideal terms.

According to at least one embodiment of the invention, a switch S can be provided which is connected to the electronic unit E. Both of these components are configured in such a way that the switch can be used to carry out switching between the high-impedance and low-impedance state of the electronic unit E. In particular, only in the closed state of the mechanical unit M. In this way, a switching function can be implemented in a simple way irrespective of the isolating function.

In terms of the method, a galvanic interruption of the conductors L1, L2, L3 of the low-voltage circuit is carried out, wherein in the opening process, before, during or after, in particular shortly after, the galvanic interruption of the conductors L1, L2, L3, the current of the conductors L1, L2, L3 of the low-circuit voltage is reduced, in particular ideally interrupted. For example by an electronic unit which is connected in series.

In a closing process, low-impedance is brought about only after the closing of the contacts of the mechanical unit.

The auxiliary switch can advantageously be configured as a module. In particular, a further connection can be provided on the electronic unit to the mechanical unit, in order to bring about high impedance of the electronic unit as well as triggering or an OFF position or an OFF state of the mechanical unit when an, in particular, adjustable, current limiting value is exceeded. In this way, a very high-performance switching device is provided, in particular with an isolating function according to the Standard.

Likewise, embodiments of the invention can very advantageously be applied for load-break switches, protection switching devices or power switches.

In the text which follows, embodiments of the invention will be explained once more with other words.

The novel electronic switching device, e.g. in the form of a load-break switch or hybrid switching device similar to a power switch, but with an isolating function, is embodied with an electronic unit or switching electronics E, mechanical unit or isolating mechanism M and auxiliary switch A.

The function of the switching device with an isolating function and a minimum switching category AC/DC x1 (AC x0—currentless switching, from AC x1—switching current; x stands for a number which defines the device category; according to the series of Standards 60947), has an auxiliary switch A which is used for electrical locking. The electrical locking acts on the electronic unit E or electronics which reduce the flow of current or (as it were) interrupts it before the opening of the mechanical contacts A. In the opened position of the mechanical unit or in the OFF position, the electrical isolating function is performed by the isolating mechanism/the contacts K.

A user switches the isolating mechanism from the closed or ON state/position in the direction of the OFF state/position. Before the contacts open/the isolating mechanism opens, the leading auxiliary switch A triggers the electronic unit E or switching electronics which reduce or (as it were) interrupt the current.

This function is compatible with the Standard IEC 60947-1, in particular section 7.1.7.2.

This new electronic switching device or load-break switch is therefore switched mechanically and in the background triggers electronics to bring about an interruption in current. After the opening of the contacts, the isolating function is provided.

The electronic unit E is activated by the mechanical unit M (e.g. contemporary load-break switch). This is done e.g. in the course of electrical locking.

The actuation is carried out here by way of a mechanically/electrically coupled signal, by rotation e.g. of the handle H of the mechanical unit M to the electronic unit (switching ON or OFF). Actuation is not carried out by an evaluation unit, as in the case of a power switch.

It is also possible to switch the mechanical unit M off if no voltage is present, e.g. after a fault/short circuit. As a result, an unambiguous assignment is achieved, the electronic switching device is OFF and the isolating function is achieved. The mechanical handle indicates OFF.

After the return of the voltage, the electronic load-break switch remains in the OFF position, i.e. at high impedance, until the handle (drive/toggle) is switched in the direction of ON.

According to at least one embodiment of the invention, in an open state of the contacts, that is to say in the OFF state, the operator control lever or the handle can be switched off or locked, for example by a lock.

According to at least one embodiment of the invention, a switch S can be provided which permits the electronic unit to become high in impedance/permits interruption of the electrical circuit, in particular in the position ON of the mechanical unit. No isolation function is brought about here.

They are slitting function is basically formed by the mechanical unit M. Particular, at least clearances and/or creepage distances are brought about. In addition, an unambiguous switched position display for the isolating function is ensured by way of the handle.

In one advantageous refinement, the electronic unit is never current-conducting if the contacts of the mechanical unit are opened, i.e. an OFF state is displayed.

The new switching device, in particular the new load-break switch, is formed from an electronic unit E and a mechanical unit M, in particular from the series connection thereof. The mechanical unit M is coupled to an auxiliary switch A which actuates the electronic unit E, as a result of which electrical locking is brought about.

Although the invention has been explained and described in detail by way of the example embodiment, the invention is not limited by the disclosed examples and other variations can be derived therefrom by a person skilled in the art without departing from the scope of protection of the invention.

The invention claimed is:

1. A switching device for a low-voltage circuit including a plurality of conductors, the switching device comprising:

a housing, connection contacts being arranged on the housing to connect conductors of the low-voltage circuit;

a mechanical unit, located in the housing, including an isolating function, an OFF or ON position and isolating contacts for galvanically interrupting the conductors of the low-voltage circuit;

an electronic unit, connected to the mechanical unit in series on a current flow side; and an auxiliary switch, connected to the mechanical unit and connected to the electronic unit via the mechanical unit, the auxiliary switch and the electronic unit being configured such that during an opening process of the mechanical unit, the electronic unit has high impedance, wherein the isolating function includes a minimum clearance of opened isolating contacts in the OFF position as a function of rated surge voltage impedance and a degree of soiling, the minimum clearance being between 0.01 mm at 0.33 kV and 14 mm at 12 kV and including a degree of soiling 1 for nonhomogeneous fields.

2. The switching device of claim 1, wherein the isolating function includes:

visibility of the isolating contacts in the OFF position, or a display of a position of the isolating contacts.

3. The switching device of claim 2, wherein the isolating function includes:

visibility of the isolating contacts in the OFF position through a transparent part of the housing, or a display of a position of the isolating contacts by an operator control lever, a switch position display or a display device.

4. The switching device of claim 2, wherein the isolating function includes a minimum clearance of opened isolating contacts in the OFF position as a function of rated surge voltage impedance and a degree of soiling, the minimum clearance being between 0.01 mm and 14 mm.

5. The switching device of claim 1, wherein the isolating function includes a minimum clearance of opened isolating contacts in the OFF position as a function of rated surge voltage impedance and a degree of soiling, the minimum clearance being between 0.01 mm and 14 mm.

6. The switching device of claim 1, wherein the mechanical unit includes an operator control lever or a switching mechanism, configured to be driven manually, by motor, pneumatically or by a spring mechanism, to activate the isolating contacts in order to bring about the OFF or ON position.

7. The switching device of claim 1, wherein, in an opening process of the mechanical unit, the impedance of the electronic unit becomes high before the opening of the isolating contacts or connection contacts, during the opening of the isolating contacts or connection contacts, or after the opening of the isolating contacts or connection contacts.

8. The switching device of claim 1, wherein the mechanical unit is a mechanical unit of a load-break switch.

9. The switching device of claim 1, wherein, in a closing process of the mechanical unit to the ON position, impedance of the electronic unit becomes low after the closing of the isolating contacts.

10. The switching device of claim 1, wherein the electronic unit is embodied with semiconductors.

11. The switching device of claim 1, wherein, when a mechanical unit is opened or there is an OFF position, impedance of the electronic unit is high.

12. The switching device of claim 1, wherein the auxiliary switch is mechanically connected to the mechanical unit, and wherein before the opening of the isolating contacts, an electrical contact of the auxiliary switch opens so that an electrical auxiliary circuit connected to the electronic unit and has the auxiliary switch is opened, so that the electronic unit subsequently reduces electrical current of the conductors of the low-voltage circuit.

13. The switching device of claim 1, wherein when isolating contacts of the mechanical unit are opened, the electronic unit has high impedance, and wherein after the closing of the isolating contacts, electrical contacts of the auxiliary switch are closed so that the electrical auxiliary circuit is closed, so that impedance of the electronic unit then becomes low.

14. The switching device of claim 1, wherein a switch is provided which is connected to the electronic unit, and wherein both of the switch and the electronic unit are configured such that the switch is usable to switch between the high-impedance and low-impedance state of the electronic unit.

15. The switching device of claim 1, wherein the auxiliary switch is embodied as a module which is coupleable to the mechanical unit.

16. The switching device of claim 1, wherein the switching device is configured such that in a de-energized state of the low-voltage circuit, the mechanical unit is always be movable into the OFF position to implement the isolating function.

17. The switching device of claim 1, wherein the switching device is configured such that in a de-energized state of the low-voltage circuit and in the OFF position of the mechanical unit, the electronic unit continues to have high impedance at a changeover to the state in which voltage is applied.

18. The switching device of claim 1, wherein the electronic unit is configured such that when a current limiting value of the low-voltage circuit is exceeded, the electronic unit changes into the high-impedance state.

19. The switching device of claim 18, wherein the electronic unit is coupled to the mechanical unit such that when the current limiting value is exceeded and the electronic unit changes into the high-impedance state, the mechanical unit is moved into the OFF position, to bring about the isolating function.

20. The switching device of claim 1, wherein the switching device is configured as an isolating switch.

21. The switching device of claim 1, wherein the electronic unit is a semiconductor switch.

22. A method for a switching device including an isolating function for a low-voltage circuit including a plurality of conductors, in which a galvanic interruption of the plurality of conductors of the low-voltage circuit is implemented with a mechanical unit, the method comprising:

reducing, during an opening process of the mechanical unit before, during or after the galvanic interruption of the plurality of conductors, current of the plurality of conductors of the low-voltage circuit by an electronic unit, wherein the isolating function includes a minimum clearance of opened isolating contacts in the OFF position as a function of rated surge voltage impedance and a degree of soiling, the minimum clearance being between 0.01 mm at 0.33 kV and 14 mm at 12 kV and including a degree of soiling 1 for nonhomogeneous fields.

23. The method of claim 22, wherein the reducing includes interrupting the current of the plurality of conductors of the low-voltage circuit.

* * * * *